US008814763B2

(12) United States Patent
Ho et al.

(10) Patent No.: US 8,814,763 B2
(45) Date of Patent: Aug. 26, 2014

(54) ABDOMEN EXERCISE MACHINE

(76) Inventors: Wei-Teh Ho, Taipei (TW); Willy Ho, Taipei (TW)

( * ) Notice: Subject to any disclaimer, the term of this patent is extended or adjusted under 35 U.S.C. 154(b) by 233 days.

(21) Appl. No.: 13/540,447

(22) Filed: Jul. 2, 2012

(65) Prior Publication Data

US 2014/0005006 A1 Jan. 2, 2014

(51) Int. Cl.
*A63B 21/062* (2006.01)

(52) U.S. Cl.
USPC ..... 482/96; 482/131; 482/140; 482/142

(58) Field of Classification Search
CPC ..... A63B 23/04; A63B 23/0432; A63B 26/00
USPC ..... 482/51, 70–72, 79, 131–133, 135, 140, 482/142, 146, 147; D21/686, 687, 688, D21/689, 690
See application file for complete search history.

(56) References Cited

U.S. PATENT DOCUMENTS

| | | | | |
|---|---|---|---|---|
| 6,514,180 | B1 * | 2/2003 | Rawls | 482/70 |
| 7,662,076 | B1 * | 2/2010 | Ho | 482/130 |
| 7,878,957 | B1 * | 2/2011 | Chen | 482/140 |
| 2009/0018000 | A1 * | 1/2009 | Brown et al. | 482/140 |
| 2010/0227748 | A1 * | 9/2010 | Campanaro et al. | 482/140 |

* cited by examiner

*Primary Examiner* — Loan H Thanh
*Assistant Examiner* — Nyca T Nguyen
(74) *Attorney, Agent, or Firm* — Blakely Sokoloff Taylor & Zafman LLP

(57) ABSTRACT

An exercise machine applicable for strengthening users abdominal muscles is described. The machine can include a track frame including a pair of parallel rails to provide gliding support for movement along the parallel rails. Two sliding assembly may be movably mounted on the parallel rails respectively. Each sliding assembly may be configurable to move together or separately along the parallel rails. Two seat pads may be adjustably secured to the two sliding assembly respectively. Each seat pad may be rotationally adjustable to change angular relationship between the seat pad's longitudinal direction and movement direction along the parallel rails.

11 Claims, 7 Drawing Sheets

ABDOMEN EXERCISE MACHINE

FIELD OF INVENTION

The present invention relates generally to physical training machines, and in particular, exercise machines structured for exercising the abdominal muscles of a user.

BACKGROUND

With the growing awareness of health problems caused by lack of exercise, popularity of exercising machines, such as stationary bicycles, treadmills, rowing machines, step climbing machines, etc., has been continuously increasing. Typically, these machines are designed to focus movements of specific parts of the body. For example, abdominal machines may be structured to induce body exercises to strengthen the abdominal muscles. Existing abdominal machines, however, are usually designed based on variations of sit-ups exercises. Effective abdominal exercises may require a combination of movements involving muscles of different parts of the body including the waist, legs, etc. Although there are many exercising machines practical for exercising different parts of the body, these multipurpose exercising machines are usually heavy and expensive devices.

Therefore, traditional abdomen machines are not versatile, effective and economic.

SUMMARY OF THE DESCRIPTION

An exercise machine applicable for strengthening a user's abdominal muscles can include a track frame having a pair of parallel rails to provide gliding support for movement along the parallel rails. The parallel rails can have a higher end and a lower end, the higher end elevated at a height above the lower end for steepness of the movement. A support frame can be adjustably affixed to the track frame to elevate the parallel rails. Two sliding assemblies may be movably mounted on the parallel rails respectively. Each sliding assembly may be configurable to move together or separately along the parallel rails. Two seat pads may be adjustably secured to the two sliding assemblies respectively. Each seat pad may be rotationally adjustable to change angular relationship between the seat pad's longitudinal direction and movement direction along the parallel rails. Each seat pad may separately form a separate leg cushion to receive a leg position of a user to allow the user to move both legs in opposite directions along the parallel rails. Alternatively, the seat pads may be attached together longitudinally aligned to form a knee cushion to receive a kneeling position of the user towards the longitudinal direction of the seat pad to force the user to move and kneel in angular directions to impose a twisting effect on the user.

Other advantages and features of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

The present invention is illustrated by way of examples and not limitations in the figures of the accompanying drawings, in which like references indicate similar elements and in which.

DETAILED DESCRIPTION

In the following description, numerous specific details are set forth, such as examples of external surfaces, named components, connections between components, etc., in order to provide a thorough understanding of the present invention. It will be apparent, however, to one skilled in the art that the present invention may be practiced without these specific details. In other instances, well known components or methods have not been described in detail but rather in a block diagram in order to avoid unnecessarily obscuring the present invention. Further specific numeric references such as first, second, third, etc., may be made. However, the specific numeric references should not be interpreted as a literal sequential order but rather interpreted as references to different objects. Thus, the specific details set forth are merely exemplary. The specific details may be varied from and still be contemplated to be within the spirit and scope of the present invention.

Reference in the specification to "one embodiment" or "an embodiment" means that a particular feature, structure, or characteristic described in connection with the embodiment can be included in at least one embodiment of the invention. The appearances of the phrase "in one embodiment" in various places in the specification do not necessarily all refer to the same embodiment.

Figure 1:
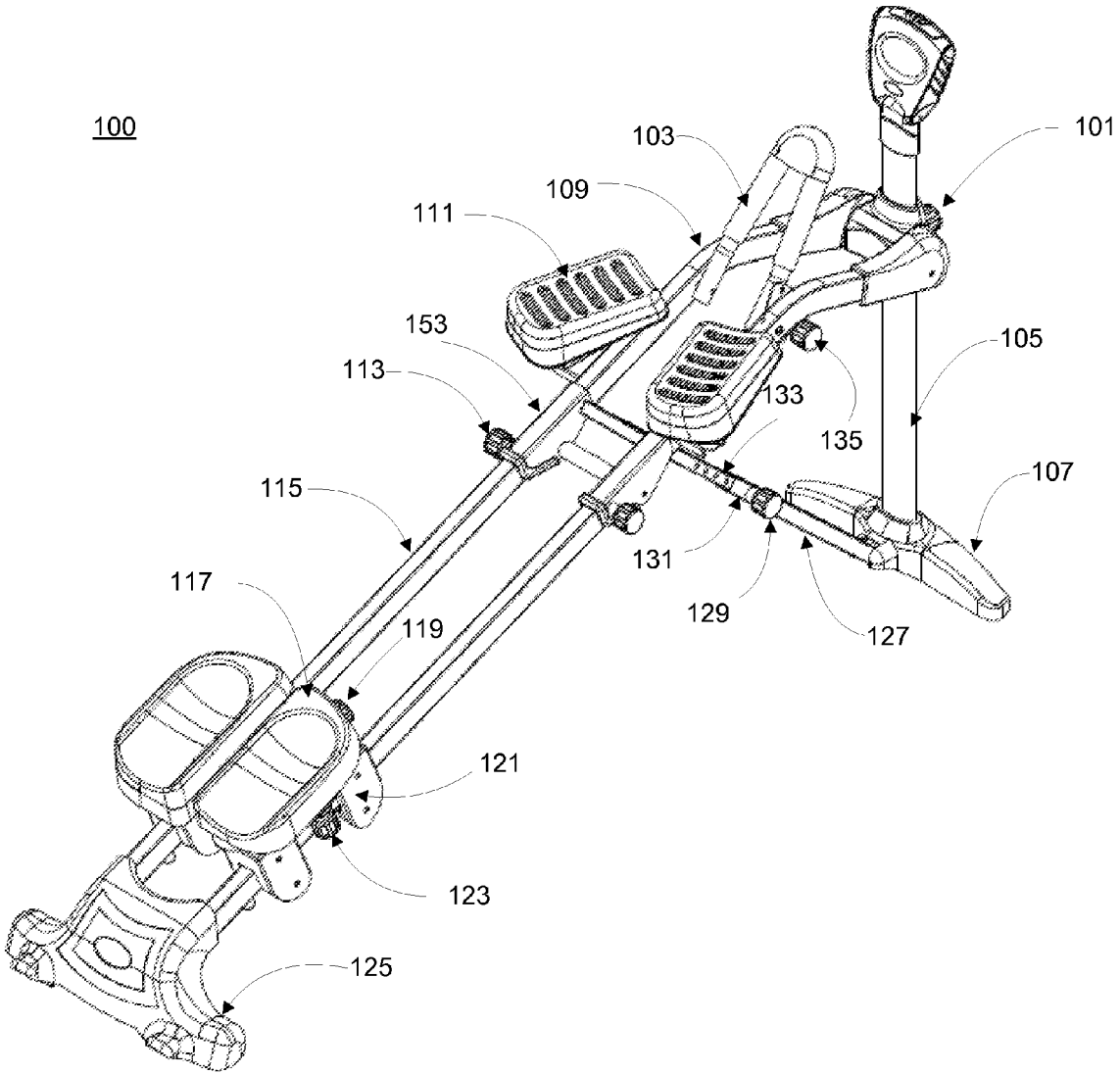
FIG. 1 is a perspective view of an embodiment of an exercise machine assembly.

FIG. 1 is a perspective view of an embodiment of an exercise machine assembly. Exercise machine (or device) 100 can include a track frame having a pair of resting bars 109 and a pair of elongated gliding rails 115 disposed in parallel. Resting bar 109 may be coupled with a support frame at a higher end of the track frame to provide lifting support for maintaining an elevated position (e.g. with a height) above a floor for the track frame at the higher end.

Gliding rails 115 may be attached to a foot base (or foot frame) 125 to provide a floor support for the track frame at a lower end of the track frame. As a result, gliding rails 115 can be tilted up from the floor (or inclined) while the lower end of the track frame rests on the floor end to enable exercise movement up and down the gliding rails 115.

In one embodiment, two mounting assemblies 121 (e.g. a first one and a second one) may be movably mounted on elongated gliding rails 115 respectively. Each mounting assembly 121 is capable of gliding along the corresponding gliding rail 115 up and down between the higher end and the lower end of the track frame.

Knee pad 117 may be mounded on top of each mounting assembly 121. Adjustment knob 123 may be provided to allow rotational adjustment of knee pad 117 over the mounting surface of mounting assembly 121. For example, knee pad 117 can be rotated relative to mounting assembly 121 with respect to an axis that is perpendicular to an axis along a corresponding elongated gliding rail 115. As a result, knee pad 117 may face a direction not aligned with movement direction of mounting assembly 121 when gliding up and down along the corresponding elongated gliding rail 115. Control knob 119 may control whether both mounting assemblies 121 move together or separately along gliding rails 115.

In one embodiment, each knee pad 117 may be formed in a shape suitable to receive knees of a user while the user is positioned facing the higher end of the track frame to allow the user to move both knee pads 117 separately in different directions or together in the same direction. Alternatively, both knee pads (or seat pads) 117 may be attached to form a seat to allow the user to sit thereon and to rest user's feet at the lower end of the track frame while gliding along gliding rails 115.

In one embodiment, two resting bars 109 may be detachably coupled with two elongated gliding rails 115 respectively via, for example, latch 153. Fasten knob 113 can loosen or tighten latch 153 for coupling resting bar 109 and gliding rail 115. Thus, different sizes (or lengths) of gliding rails may be adapted to accommodate, for example, different users or usage requirements related to strenuousness of the exercise movement. Each resting bar may be aligned with a corresponding gliding rail coupled. The track frame and the support frame may be coupled at the higher end of the track frame via resting bars 109.

Two elbow pads 111 may be fixedly attached to resting bars 109 respectively. Each elbow pad 111 may have an elbow cushion to receive a resting elbow of a user of exercise machine 100 to move along the track frame. Handlebar 103 may be adjustably mounted on resting bars 109 to support hand holding from the user with resting elbows on elbow pads 111. Handlebar 103 may have two ends fixedly positioned on separate resting bars 109. Adjustment of handlebar 103, for example, via adjustment knob 135, may allow rotating handlebar 103 around an axis formed by the two ends of handlebar 103 to change distances between handlebar 103 and elbow pads 111.

In one embodiment, a support frame can include upright 105 standing, for example, perpendicularly upward, on a base 107. Upright 105 may be adjustably affixed to the higher end of the track frame. Knob 101 of an adjustment rod can allow the track frame to be coupled at various vertical positions along upright 105 to achieve a desired height at the higher end of the track frame.

The support frame can include an extendable support bar 131 having a fixed end affixed at base 107. Extendable support bar 131 can have an extendable end attached to the track frame to provide additional vertical support of the track frame. In one embodiment, extendable support bar 131 can include a lower section 127 with the fixed end and an upper section 133 with the extendable end. Lower section 127 can have an insert and a locking mechanism with adjustment knob 129. Upper section 133 can have a series of longitudinally spaced apertures to selectively engage with lower section 127 inside the insert at one of the apertures via the locking mechanism according to a desired height for the track frame.

In some embodiments, exercise machine 100 may include a track frame having a pair of parallel rails 115 to provide gliding support for movement along the parallel rails. Parallel rails 115 may have a higher end and a lower end. The higher end may be elevated at a height above the lower end for steepness of the movement. Additionally, exercise machine 100 may include a support frame adjustably affixed to the track frame. The support frame can provide elevation of the height for the parallel rails 115.

Two sliding assemblies 121 may be movably mounted on the parallel rails 115 respectively. Sliding assemblies 121 may be configurable to move together or separately along parallel rails 115. Optionally or additionally, two seat pads 117 may be adjustably secured to sliding assemblies 121 respectively. Each seat pad 117 can have a longitudinal direction. Each seat pad 117 may be rotationally adjustable to change angular relationship between the longitudinal direction and movement direction along the parallel rails 115.

In some embodiments, each seat pad (or knee pad) 117 can separately form a leg cushion to receive a leg position of a user of exercise machine 100 to allow the user to move both legs in opposite directions along parallel rails 115. Alternatively, seat pads 117 may be attachable together longitudinally aligned to form a knee cushion to receive a kneeling position of the user towards the longitudinal direction. The angular relationship between the longitudinal direction of seat pads 117 and movement direction along parallel rails 115 can allow the user to move and kneel in different directions to impose a twisting effect to exercise abdomen related muscles.

In one embodiment, exercise machine 100 may include a holding frame to provide hand holding support for a user, a track frame to provide movement support for the user, and/or a foot base 125 to provide floor support for machine 100. The holding frame may include resting bars 109, handlebar 103 and/or elbow pads 111.

The track frame may include a first rail and a second rail 115 affixed to the holding frame in parallel. The track frame may further include two moving assemblies 121 movably mounted on rails 115 separately. Two seat pads (or cushions) 117 may be adjustably secured to moving assemblies 121 separately. Adjustment of the seat pads 117 may allow the seat pads 117 to rotate on the moving assemblies 121. Seat pads 117 may be configurable to receive separate leg positions from the user to move both legs in opposite directions along separate rails 115.

Alternatively, moving assemblies 121 may be attachable together to form a single cushion with attached seat pads 117 rotationally adjusted to be aligned towards a common direction. For example, both seat pads 117 may face a floor direction to receive a resting or sitting position for the user to move both legs together along rails 115.

For example, the single cushion can be attached toward a common direction not aligned with movement direction along rails 115. As a result, the single cushion can receive a kneeling position from the user to move along rails 115 while imposing a twisting effect on the user. Optionally, the single cushion can be attached to align with the movement direction along rails 115 to receive a sitting position from the user to allow the user to rest both feet on foot base 125 for the movement.

Figure 2:
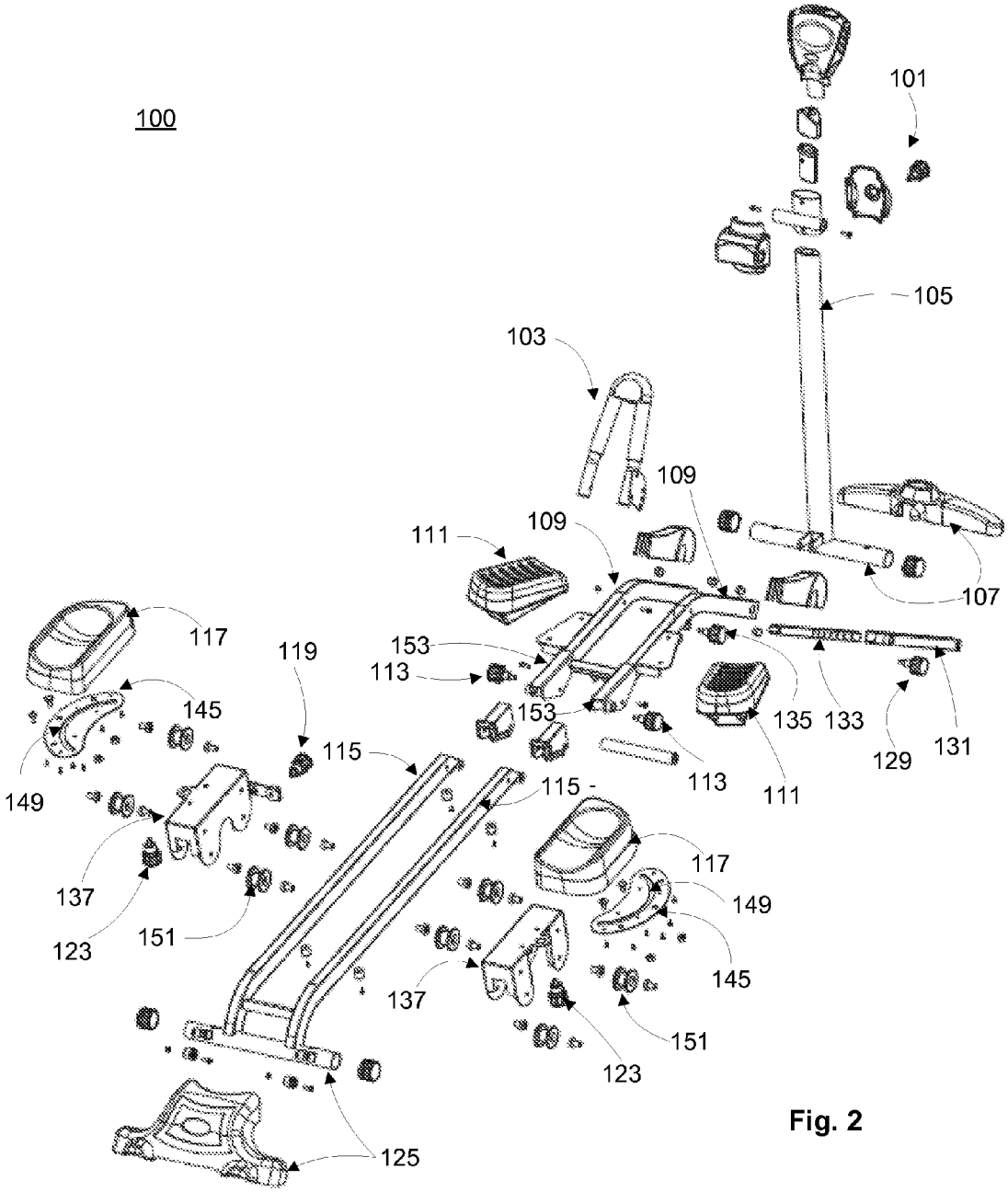
FIG. 2 is an exploded perspective view of an embodiment of an exercise machine assembly.

FIG. 2 is an exploded perspective view of an embodiment of an exercise machine assembly as shown in FIG. 1. For example, mounting assembly, such as mounting assembly 121 of FIG. 1, can include slide bracket 137 attached with one or more wheels 151 slideably attachable to elongated gliding rail 151. A coupling control mechanism via control knob 119 can fasten two sliding brackets 137 together or slide brackets 137 separated to configure corresponding mounting assemblies 121 to move together or separately along gliding rails 151.

In one embodiment, seat pad 117 may be affixed with plate 145 on an opposite side to surface of seat pad 117. Plate 145 may include a curved track 149 which can be a hollow cut to allow rotational or curved position adjustment over slide bracket 137. For example, seat pad 117 may be attached to slide bracket 137 with adjustment knob 123 secured in a position along curved track 149 to rotate seat pad 117 to a desired direction.

Figure 3A:
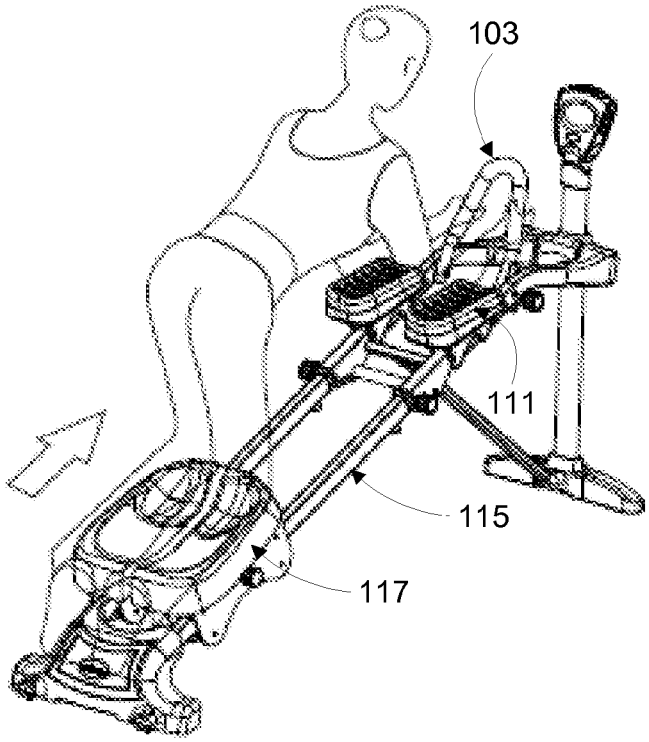
FIGS. 3A-3B show a first example of an application of the present invention.
Figure 3B:
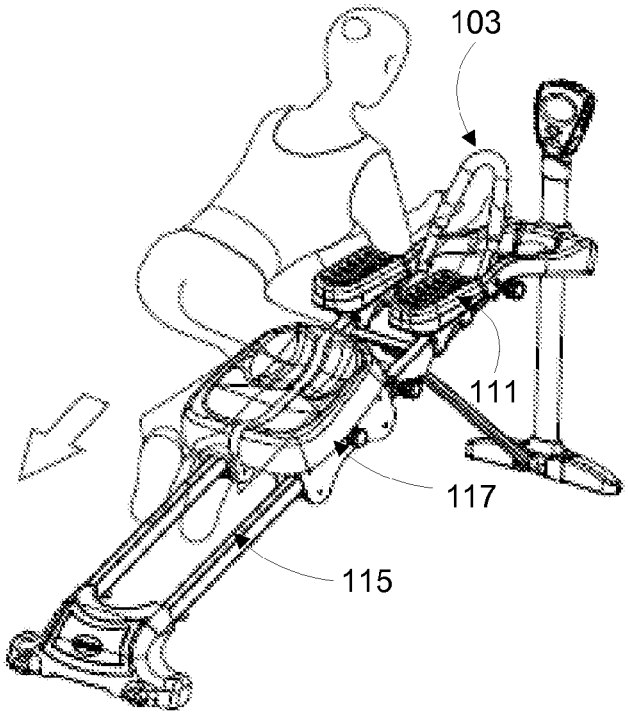

FIGS. 3A-3B show a first example of an application of the present invention. For example, the user can hold handlebar 103 with the both hands with elbows resting on elbow pads 111 and kneel on two knee pads 117 attached to move together. The user can alternatively contract and release the abdominal muscles to move knee pads 117 along sliding rails 115 simultaneously with the legs. Knee pads 117 can slide up along gliding rails 115 to substantially touch elbow pads 111 to bring the knees close to the elbows.

Figure 4A:
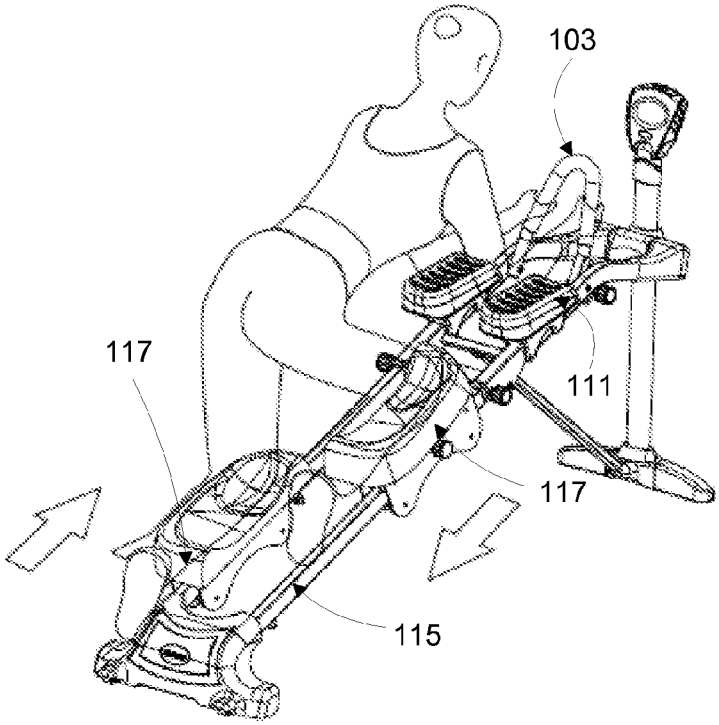
FIGS. 4A-4B show a second example of an application of the present invention.
Figure 4B:
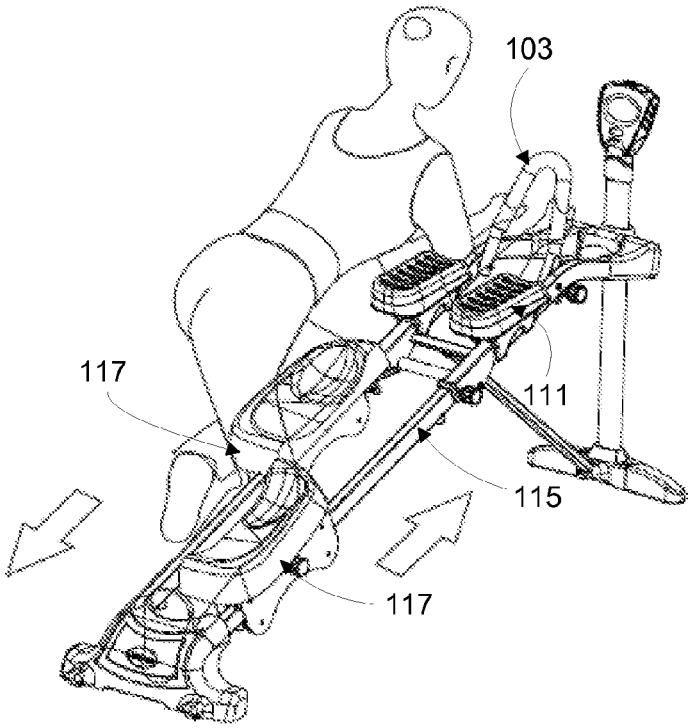

FIGS. 4A-4B show a second example of an application of the present invention. Similar to the application in FIGS. 3A-3B, the user can hold handlebar 103 with the both hands with elbows resting on elbow pads 111. Knee cushions or knee pads 117 are configured to be separately movable. The user can put one knee on each seat cushion 117 separately and slide one leg forward all the way to touch or close in on the elbow on elbow pads 111 while the other leg sliding backward away from the elbow and alternatively repeat the back and forth movement along gliding rails 115.

Figure 5A:
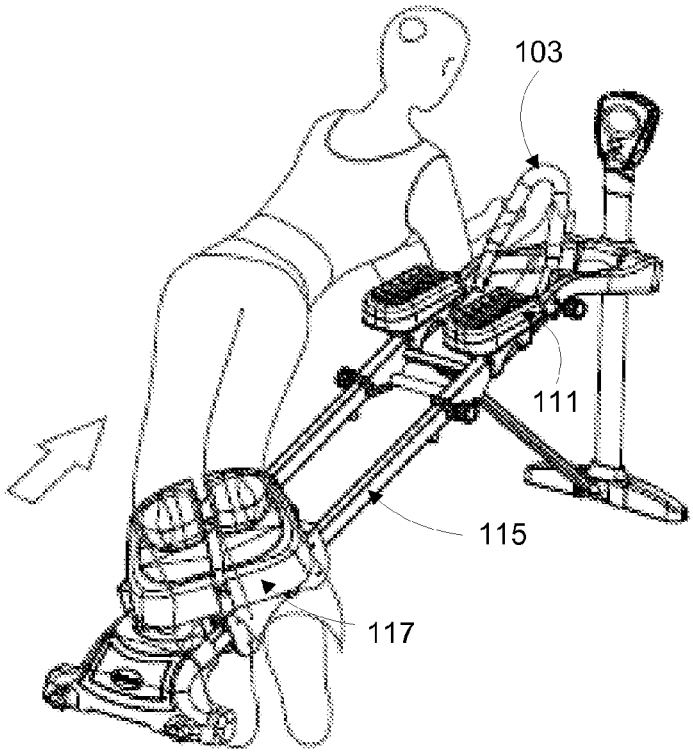
FIGS. 5A-5B show a third example of an application of the present invention.
Figure 5B:
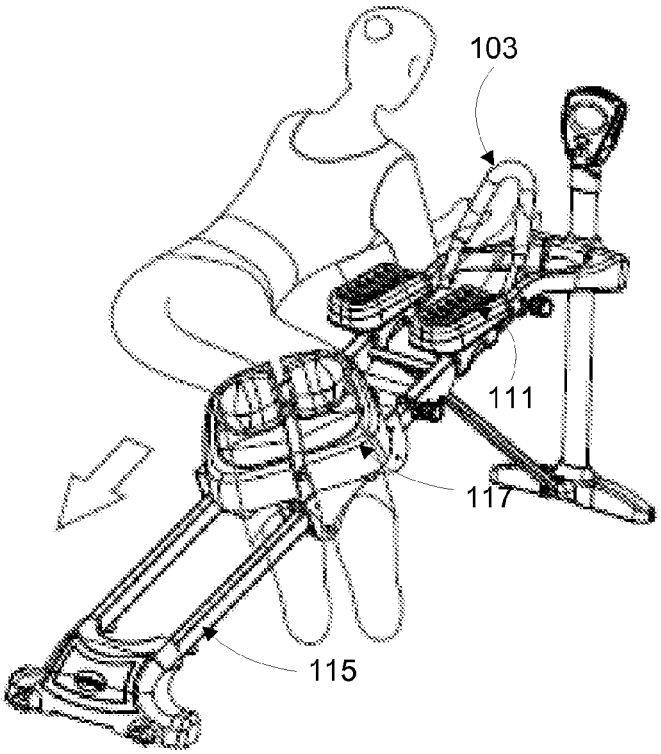

FIGS. 5A-5B show a third example of an application of the present invention. Similar to the application in FIGS. 3A-3B, the user kneels on two seat pads 117 attached to move together. Seat pads 117 are adjusted to rotate an angle towards left relative to movement direction along rails 115. As a result, a twisting effect can be imposed to abdomen related muscles of the user during movement along gliding rails 115.

Figure 6A:
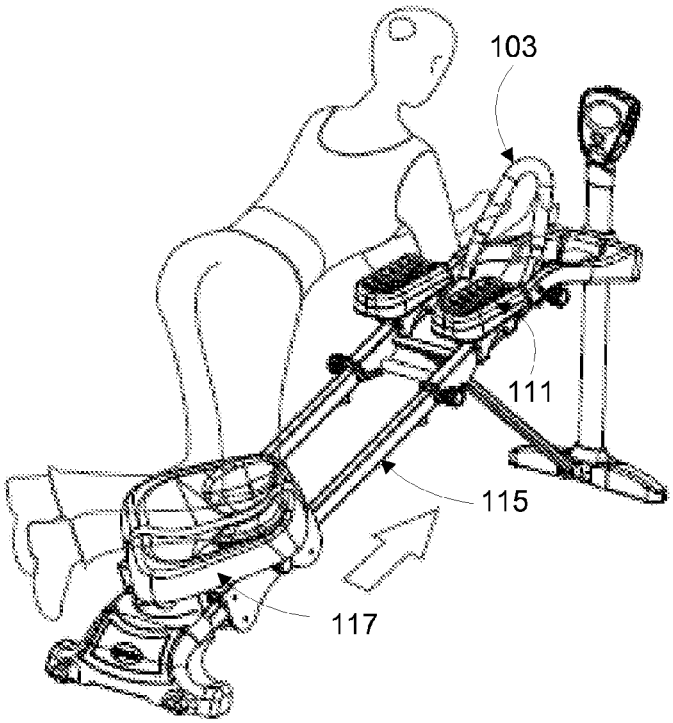
FIGS. 6A-6B show a fourth example of an application of the present invention.
Figure 6B:
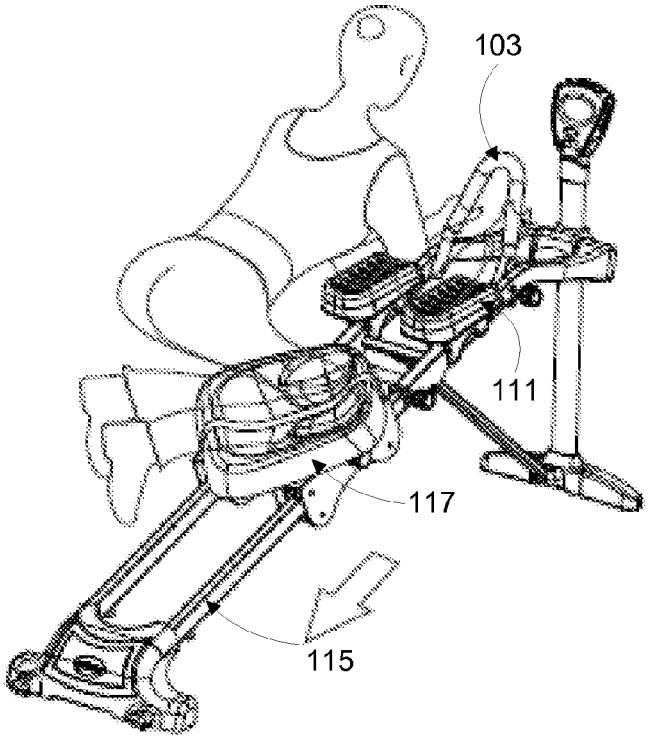

FIGS. 6A-6B show a fourth example of an application of the present invention similar to the application in FIGS. 5A-5B. Seat cushions 117 are rotated to the right to twist user's muscles in a different direction than the application in FIGS. 5A-5B.

Figure 7A:
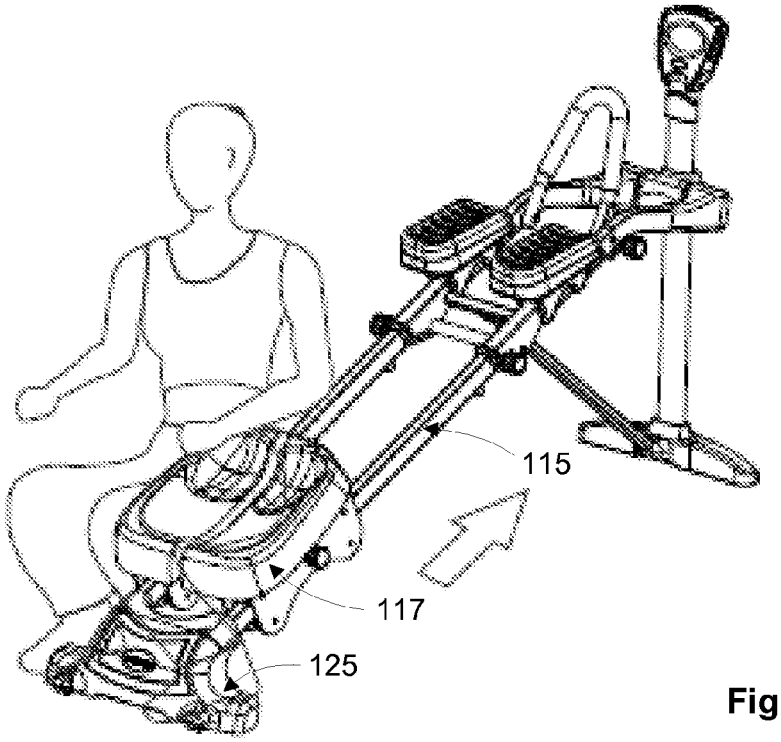
FIGS. 7A-7B show a fifth example of an application of the present invention.
Figure 7B:
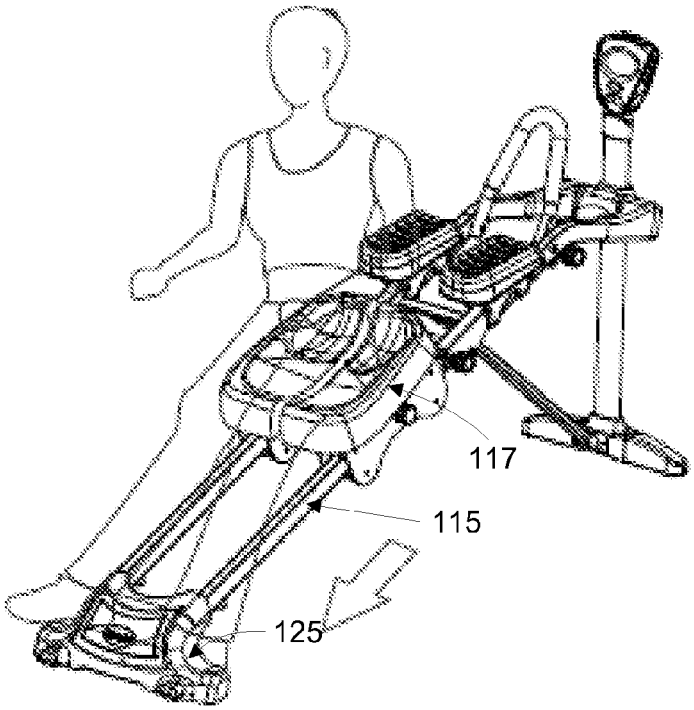

FIGS. 7A-7B show a fifth example of an application of the present invention. The user can sit on seat pads 117 attached to move together. The user can rest two feet on foot base 125 and then push and pull both legs to move seat pads 117 back and forth along gliding rails 115.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An exercise machine comprising:

a track frame having a first elongated gliding rail and a second elongated gliding rail in parallel, the track frame including a higher end and a lower end;

a support frame coupled to the higher end of the track frame to provide support from a floor supporting the exercise machine, the support frame causing the track frame to be inclined while the lower end of the track frame rests on the floor;

a first mounting assembly and a second mounting assembly movably mounted on the first and second elongated gliding rails, respectively, wherein the first and second mounting assemblies are capable of gliding along the first and second elongated gliding rails up and down between the higher end and the lower end of the track frame a coupling control mechanism to allow configurations of the first and second mounting assemblies to move together and separately in opposite directions along the first and second elongated gliding rails;

a first knee pad rotatably mounted on the first mounting assembly, wherein the first knee pad is capable of rotating relative to the first mounting assembly with respect to an axis that is perpendicular to an axis along the first elongated gliding rail while the first mounting assembly glides up and down along the first elongated gliding rail; and a second knee pad rotatably mounted on the second mounting assembly, wherein the second knee pad is capable of rotating relative to the second mounting assembly with respect to an axis that is perpendicular to an axis along the second elongated gliding rail while the second mounting assembly glides up and down along the second elongated gliding rail.

2. The exercise machine of claim 1, wherein the first and the second knee pads are formed in a shape suitable to receive knees of a user while the user is positioned facing the higher end of the track frame, and wherein the shape allows the user to sit thereon facing away from the higher end of the track frame with the user's feet resting at the lower end of the track frame.

3. The exercise machine of claim 1, wherein each mounting assembly mounted on one of the first and second elongated gliding rails comprises:

a slide bracket attached with one or more wheels slideably connected to the one elongated gliding rail.

4. The exercising machine of claim 1, further comprising:

a first resting bar detachably coupled with the first elongated gliding rail, the first resting bar aligned with the first elongated gliding rail; and a second resting bar detachably coupled with the second elongated gliding rail, the second resting bar aligned with the second elongated gliding rail, wherein the track frame and the support frame are coupled at the higher end of the track frame via the first and second resting bars and wherein the resting bars are detachable from the elongated rails to allow adaptation of different sizes of the elongated rails.

5. The exercising machine of claim 4, further comprising:

two elbow pads fixedly attached to the first and second resting bars respectively, each elbow pad having an elbow cushion to receive a resting elbow of a user to cause the movement; and a handlebar adjustably mounted on the first and second resting bars to support hand holding from the user with resting elbows on elbow cushions of the elbow pads, the handlebar having two ends fixedly positioned separately on the first and second resting bars, adjustment of the handlebar to allow rotating the handlebar around an axis formed by the two ends to change distances between the handlebar and the elbow pads.

6. The exercise machine of claim 1, wherein the support frame comprises:

an upright having a base, the higher end of the track frame affixed to the upright adjustably positioned corresponding to a height of the track frame; and an extendible support bar having a fixed end affixed at the base, the extendible support bar having an extendible end attached to the track frame to provide additional support for the height of the track frame.

7. The exercise machine of claim 6, wherein the extendible support bar comprises a lower section with the fixed end and an upper section with the extendible end, the lower section having an insert and a locking mechanism, the upper section having a series of longitudinally spaced apertures to selectively engage with the lower section inside the insert at one of the apertures via the locking mechanism to adjust the height of the track frame.

8. An exercise machine comprising:

a track frame including a pair of parallel rails to provide gliding support for movement along the parallel rails, wherein the parallel rails have a higher end and a lower end, the higher end elevated at a height above the lower end for steepness of the movement;

a support frame adjustably affixed to the track frame, the support frame providing elevation of the height for the parallel rails;

two sliding assemblies movably mounted to the parallel rails respectively a coupling control mechanism to allow configurations of the two sliding assemblies to move together and separately in opposite directions along the parallel rails; and two seat pads adjustably secured to the two sliding assemblies respectively, each seat pad having a longitudinal direction, the seat pad rotationally adjustable to change angular relationship between the longitudinal direction and movement direction along the parallel rails, wherein each seat pad separately forms a leg cushion to receive a leg position of a user to allow the user to move both legs in opposite directions along the parallel rails, wherein the seat pads are attachable together by the coupling control mechanism to be longitudinally aligned to form a knee cushion to receive a kneeling position of the user towards the longitudinal direction, the angular relationship allowing the user to move and kneel in different directions to impose a twisting effect.

9. An exercise machine comprising:

a holding frame to provide hand holding support for a user; and a track frame to provide movement support for the user, the track frame comprising a first rail and a second rail affixed to the holding frame in parallel, a first moving assembly movably mounted on the first rail, a second moving assembly movably mounted on the second rail a coupling control mechanism to allow configurations of the first and second moving assemblies to move together and separately in opposite directions along the first and second rails;

a first seat pad adjustably secured to the first moving assembly, adjustment of the first seat pad allowing the first seat pad to rotate on the first moving assembly, and a second seat pad adjustably secured to the second moving assembly, adjustment of the second seat pad allowing the second seat pad to rotate on the second moving assembly, wherein the first seat pad and the second seat pad are configurable to receive separate leg positions from the user to move both legs in opposite directions along the first and second rails, and wherein the first and second moving assemblies are attachable together by the coupling control mechanism to form a single cushion having the first and second seat pads rotationally adjusted to be aligned towards a direction to receive a resting position for the user to move both legs together along the first and second rails.

10. The exercise machine of claim 9, wherein the single cushion receives a kneeling position from the user to move along the first and second rails, and wherein the direction of the single cushion is not aligned with movement direction along the first and second rails to impose a twisting effect on the user.

11. The exercise machine of claim 9, further comprising a resting frame to provide floor support for the track frame, wherein the single cushion receives a sitting position from the user to move along the first and second rails, and wherein the direction of the single cushion is aligned with movement direction along the first and second rails to allow the user to rest both feet on the resting frame for the movement.

* * * * *